US008347851B2

(12) United States Patent
Okumura et al.

(10) Patent No.: US 8,347,851 B2
(45) Date of Patent: Jan. 8, 2013

(54) FUEL INJECTION CONTROL DEVICE FOR INTERNAL COMBUSTION ENGINE

(75) Inventors: Fumihiro Okumura, Susono (JP); Shigeo Nomura, Toyohashi (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 325 days.

(21) Appl. No.: 12/676,409

(22) PCT Filed: Sep. 8, 2008

(86) PCT No.: PCT/JP2008/066503
§ 371 (c)(1),
(2), (4) Date: Mar. 4, 2010

(87) PCT Pub. No.: WO2009/031713
PCT Pub. Date: Mar. 12, 2009

(65) Prior Publication Data

US 2010/0170475 A1 Jul. 8, 2010

(30) Foreign Application Priority Data

Sep. 7, 2007 (JP) ..... 2007-232703

(51) Int. Cl.
*F02B 3/00* (2006.01)
*F02B 3/02* (2006.01)

(52) U.S. Cl. ..... 123/299; 123/305

(58) Field of Classification Search ..... 123/445, 123/457, 299, 305, 490, 456, 467; 239/533.3, 239/533.12, 546, 585.1, 585.5, 584
See application file for complete search history.

(56) References Cited

U.S. PATENT DOCUMENTS

| | | | | |
|---|---|---|---|---|
| 6,220,528 | B1 | 4/2001 | Cooke et al. | |
| 2003/0010845 | A1 | 1/2003 | Carroll, III et al. | |
| 2005/0089426 | A1 | 4/2005 | Kurz et al. | |
| 2005/0224598 | A1 | 10/2005 | Potz et al. | |
| 2010/0200679 | A1 * | 8/2010 | Haba | 239/584 |

FOREIGN PATENT DOCUMENTS

DE 102 22 196 A1 11/2003

(Continued)

OTHER PUBLICATIONS

Translation of the International Preliminary Report on Patentability for PCT/JP2008/066503 mailed Apr. 8, 2010.

*Primary Examiner* — Mahmoud Gimie
(74) *Attorney, Agent, or Firm* — Finnegan, Henderson, Farabow, Garrett & Dunner, LLP

(57) ABSTRACT

When a control valve allows communication through a fuel drain channel, fuel flows into an inner control chamber from an outer control chamber through a communication channel and flows out to a fuel tank. The fuel flow through the communication channel generates a differential pressure between inner control pressure and outer control pressure. Thus, an outer differential pressure immediately after an outer valve opening time can be set small, restraining an increase in the unburnt HC content of exhaust gas at low load, which could otherwise result from a high rising speed of an outer needle valve immediately after the outer valve opening time. An inner differential pressure immediately after an inner valve opening time can be set large, restraining an increase in the smoke content of exhaust gas, which could result from a low rising speed of an inner needle valve immediately after the inner valve opening time.

11 Claims, 10 Drawing Sheets

FOREIGN PATENT DOCUMENTS

| | | | |
|---|---|---|---|
| DE | 102 46 974 | A1 | 4/2004 |
| DE | 103 34 209 | A1 | 2/2005 |
| DE | 103 42 567 | A1 | 4/2005 |
| DE | 103 43 998 | A1 | 4/2005 |
| DE | 10 2004 028 618 | A1 | 12/2005 |
| EP | 0 967 383 | A2 | 12/1999 |
| EP | 1 519 032 | A1 | 3/2005 |
| JP | 2002-322970 | | 11/2002 |
| JP | 2005-526211 | | 9/2005 |
| JP | 2005-320904 | | 11/2005 |
| JP | 2006-528743 | | 12/2006 |
| JP | 2007-224896 | | 9/2007 |
| WO | WO 03/098028 | A1 | 11/2003 |
| WO | WO 2004/033890 | A1 | 4/2004 |
| WO | WO 2005/014997 | A1 | 2/2005 |

* cited by examiner

FUEL INJECTION CONTROL DEVICE FOR INTERNAL COMBUSTION ENGINE

CROSS-REFERENCE TO RELATED APPLICATIONS

This application is a national phase application of International Application No. PCT/JP2008/066503, filed Sep. 8, 2008, and claims the priority of Japanese Application No. 2007-232703, filed Sep. 7, 2007, the contents of both of which are incorporated herein by reference.

TECHNICAL FIELD

The present invention relates to a fuel injection control apparatus for an internal combustion engine.

BACKGROUND ART

A conventionally known fuel injection control apparatus of a so-called twin needle type adjusts the backside pressures of outer and inner needle valves, which are coaxially accommodated within a valve body, so as to adjustment the lifts of the outer and inner needle valves, to thereby control the injection of fuel (refer to, for example, Japanese Patent Application Laid-Open (kokai) No. 2005-320904).

FIG. 7 shows an example of a fuel injection control apparatus of this type. A fuel injection control apparatus 10 shown in FIG. 7 includes a fuel pump 20, a common rail 30, injectors 40, an ECU 50 for controlling the fuel pump 20 and the injectors 40, and a fuel tank T.

The fuel pump 20 sucks fuel stored in the fuel tank T and discharges the fuel. The fuel discharged from the fuel pump 20 and having high pressure (rail pressure Pcr) is supplied to the common rail 30. The fuel having the rail pressure Pcr is supplied to the injectors 40 from the common rail 30 through a fuel supply channel C1, which will be described later. Each of the injectors 40 injects the fuel into a combustion chamber (not shown) of an internal combustion engine (particularly, a diesel engine).

The injector 40 has a body 41. The body 41 has first nozzle holes (first nozzle hole group) 41*a* formed at its tip portion, which faces the combustion chamber of the internal combustion engine, and second nozzle holes (second nozzle hole group) 41*b* located toward its tip (downward in FIG. 7) with respect to the first nozzle holes 41*a*. A tubular outer needle valve 42 is slidably accommodated in a predetermined space of the body 41. A tip portion (a lower portion in FIG. 7) of the outer needle valve 42 opens and closes the first nozzle holes 41*a*. A rod-like inner needle valve 43 is slidably accommodated in the outer needle valve 42. A tip portion (a lower portion in FIG. 7) of the inner needle valve 43 opens and closes the second nozzle holes 41*b*.

A cylindrical piece 44 independent of the body 41 is disposed in the predetermined space of the body 41 and is unitarily fixed to the body 41. A lower end portion of the inner circumferential surface of the piece 44 is fitted to an upper end portion of the outer circumferential surface of the outer needle valve 42. Thus, the predetermined space of the body 41 is divided into a nozzle chamber R1 and a control chamber R2.

The nozzle chamber R1 is provided on the tip side of the outer and inner needle valves 42 and 43. The pressure (rail pressure Pcr) of fuel in the nozzle chamber R1 applies force to the outer and inner needle valves 42 and 43 from the tip side in a valve opening direction. In a state in which the outer and inner needle valves 42 and 43 are opened, the fuel in the nozzle chamber R1 is injected into the combustion chamber through the first and second nozzle holes 41*a* and 41*b*.

The control chamber R2 is provided on a back side (upper side in FIG. 7) of the outer and inner needle valves 42 and 43. The pressure (control pressure Pc) of fuel in the control chamber R2 applies force to the outer and inner needle valves 42 and 43 from the back side in a valve closing direction.

The apparatus shown in FIG. 7 has the fuel supply channel C1, a fuel inflow channel C2, and a fuel drain channel C3. The fuel supply channel C1 connects the common rail 30, which stores fuel having the rail pressure Pcr, and the nozzle chamber R1. The fuel inflow channel C2 connects the control chamber R2 and the fuel supply channel C1, and the fuel drain channel C3 connects the control chamber R2 and the fuel tank T. An orifice Z1 is installed in the fuel inflow channel C2 and the fuel drain channel C3.

A 2-position 3-port control valve 45 is installed in the fuel inflow channel C2 and the fuel drain channel C3. The control valve 45 functions such that, when communication is established in the fuel inflow channel C2, the fuel drain channel C3 is shut off (first position as shown in FIG. 7) and such that, when the fuel inflow channel C2 is shut off, communication is established in the fuel drain channel C3 (second position). Hereinafter, the fuel injection control apparatus of the twin needle type shown in FIG. 7 may be called "the first conventional apparatus." The lifts of the outer and inner needle valves 42 and 43 mean the distances of upward movement (rising distances) of the outer and inner needle valves 42 and 43 from the state shown in FIG. 7.

Next, referring to FIG. 8, an example operation of the above-mentioned first conventional apparatus will be described. Notably, when the outer and inner needle valves 42 and 43 are closed (as shown in FIG. 7; lift=0), a gap δL between an upper end surface 42*a* (back surface) of the outer needle valve 42 and a lower surface 43*a* of a flange portion of the inner needle valve 43 is assumed to be a value L1.

When the closed outer and inner needle valves 42 and 43 are to be opened (when a valve closed state is to be changed to a valve opened state (lift>0)), the operational position of the control valve 45 is changed from the above-mentioned first position to the above-mentioned second position (see time tA). By this positional change, the fuel begins to be drained from the control chamber R2 through the fuel drain channel C3. As a result, at and after time tA, the control pressure Pc lowers from the rail pressure Pcr.

In the first conventional apparatus, the outer needle valve 42 is lower than the inner needle valve 43 in the ratio of a control pressure Pc receiving area on the back side to a rail pressure Pcr receiving area on the tip side. Accordingly, an "outer needle valve opening pressure P1" (a control pressure Pc at the time of transfer of the outer needle valve 42 from a closed state to an opened state) is higher than an "inner needle valve opening pressure P2 (a control pressure Pc at the time of transfer of the inner needle valve 43 from the closed state to the opened state).

Thus, when the control pressure Pc which is lowering from the rail pressure Pcr reaches the outer needle valve opening pressure P1, only the outer needle valve 42 opens (moves upward in FIG. 7). As a result, fuel injection is started and performed only through the first nozzle holes (first nozzle hole group) 41*a* (see time tB). Hereinafter, the time when the outer needle valve 42 opens may be called "the outer valve opening time."

When the outer needle valve 42 opens, the fuel having the rail pressure Pcr enters between the outer needle valve 42 and an outer needle valve seat portion 41*c*. For this reason, only immediately after the outer valve opening time, the outer needle valve 42 rises at a speed corresponding to the differential pressure between the rail pressure Pcr and the control pressure Pc. Subsequently, the outer needle valve 42 rises at a speed corresponding to the flow rate of fuel passing through the orifice Z1 (outflow rate Qout). Also, this speed of the outer needle valve 42 depends on the rate of change of the control pressure Pc.

The upper end surface 42*a* of the outer needle valve 42 which moves upward as mentioned above comes into contact with the lower surface 43*a* of the flange portion of the inner needle valve 43 (i.e., the gap δL becomes 0; see time tC). Subsequently, the outer and inner needle valves 42 and 43 can rise only unitarily. Hereinafter, a unitary body of the outer and inner needle valves 42 and 43 may be called "the unitary needle valve." The time when the upper end surface 42*a* of the outer needle valve 42 comes into contact with the lower surface 43*a* of the flange portion of the inner needle valve 43 may be called "the needle valve contact time."

When the lowering control pressure Pc reaches the inner needle valve opening pressure P2, the inner needle valve 43 also opens (moves upward in FIG. 7). As a result, fuel injection is started and performed also through the second nozzle holes (second nozzle hole group) 41*b* (see time tD). Hereinafter, the time when the inner needle valve 43 opens may be called "the inner valve opening time."

Similar to the outer needle valve 42, in this unitary needle valve (inner needle valve 43), when the inner needle valve 43 opens, the fuel having the rail pressure Pcr enters between the inner needle valve 43 and an inner needle valve seat portion 41*d*. For this reason, only immediately after the inner valve opening time, the inner needle valve 43 rises at a speed corresponding to the differential pressure between the rail pressure Pcr and the control pressure Pc. Subsequently, the inner needle valve 43 rises at a speed corresponding to the outflow rate Qout. Also, this speed of the inner needle valve 43 depends on the rate of change of the control pressure Pc.

When the opened outer and inner needle valves 42 and 43 are to be closed (when the valve opened state is to be changed to the valve closed state), the operational position of the control valve 45 is changed from the second position to the first position (see time tE). By this positional change, the drainage of fuel from the control chamber R2 through the fuel drain channel C3 is halted, and the inflow of fuel into the control chamber R2 through the fuel inflow channel C2 is started. As a result, at and after time tE, the control pressure Pc rises toward the rail pressure Pcr.

At and after time tF, which is slightly after time tE, the unitary needle valve lowers (moves downward in FIG. 7), and, first, the inner needle valve 43 closes (see time tG). Accordingly, fuel injection through the second nozzle holes (second nozzle hole group) 41*b* ends. Subsequently, the outer needle valve 42 lowers independent of the inner needle valve 43 and then closes (see time tH). Accordingly, fuel injection through the first nozzle holes (first nozzle hole group) 41*a* also ends. Hereinafter, the times when the outer and inner needle valves 42 and 43 close may be called "the outer valve closing time" and "the inner valve closing time," respectively. In this manner, the control valve 45 is controlled so as to control the control pressure Pc, whereby the lifts of the outer and inner needle valves 42 and 43 are adjusted, thereby controlling fuel injection.

DISCLOSURE OF THE INVENTION

The above-mentioned first conventional apparatus may involve the following phenomenon: immediately after the needle valve contact time (see time tC in FIG. 8), the impact of collision of the outer needle valve 42 against the inner needle valve 43 causes the inner needle valve 43 to be opened for a very short period of time (hereinafter, this phenomenon is called "bounce of the inner needle valve"). The occurrence of bounce of the inner needle valve raises a problem of unnecessary fuel injection through the second nozzle holes (second nozzle hole group) 41*b*.

A conceivable measure to cope with this problem is, for example, to reduce the differential pressure between the rail pressure Pcr and the backside pressure of the inner needle valve 43, thereby restraining the degree of bounce of the inner needle valve. From this point of view, the inventor of the present invention has proposed a fuel injection control apparatus of the twin needle type shown in FIG. 9 by Japanese Patent Application No. 2006-256204. In FIG. 9, members and portions similar to or equivalent to those shown in FIG. 7 are denoted by reference numerals similar to those shown in FIG. 7, and redundant description thereof is omitted. Hereinafter, the fuel injection control apparatus of the twin needle type shown in FIG. 9 may be called "the second conventional apparatus."

The above-mentioned second conventional apparatus differs from the first conventional apparatus only in the following three points. First, a space corresponding to the control chamber R2 of the first conventional apparatus is divided into an outer control chamber R2*o* and an inner control chamber R2*i*. This division is established as follows: an upper end portion of the outer circumferential surface of the inner needle valve 43 is fitted into a lower end portion of the inner circumferential surface of a cylindrical member 46 unitarily fixed to the body 41. Thus, the pressure of fuel in the outer control chamber R2*o* (outer control pressure Pco) and the pressure of fuel in the inner control chamber R2*i* (inner control pressure Pci) apply forces to the outer and inner needle valves 42 and 43, respectively, from the back side in a valve closing direction.

Secondly, the cylindrical member 46 has a communication channel 47 formed therein for establishing communication between the outer control chamber R2*o* and the inner control chamber R2*i*. Thirdly, the common end of the fuel inflow channel C2 and the fuel drain channel C3 which is located on a side toward the control chamber is connected only to the outer control chamber R2*o*.

Next, referring to FIG. 10, an example operation of the above-mentioned second conventional apparatus will be described. Times tA to tH in FIG. 10 correspond to those in FIG. 8. As shown in FIG. 10, in the second conventional apparatus, in a period when the control valve 45 is at the above-mentioned second position (see a period of tA to tE), fuel in the inner control chamber R2*i* flows into the outer control chamber R2*o* through the communication channel 47, and fuel in the outer control chamber R2*o* flows out to the fuel tank T through the fuel drain channel C3. In the above-mentioned period, the flow of fuel through the communication channel 47 causes the generation of differential pressure between the outer control pressure Pco and the inner control pressure Pci. Because of the generation of the differential pressure, the inner control pressure Pci (see the solid line) can change while being higher than the control pressure Pc (see the dash-dot line) in the first conventional apparatus, and the outer control pressure Pco (see the solid line) can change while being lower than the control pressure Pc.

Accordingly, the differential pressure between the rail pressure Pcr and the inner control pressure Pci (inner differential pressure δPci) at the needle valve contact time (see time tC) in the second conventional apparatus can change while being smaller than the differential pressure δPc between the rail pressure Pcr and the control pressure Pc at the needle valve contact time in the first conventional apparatus. As a result, even when the outer needle valve 42 collides against the inner needle valve 43 as mentioned above, the degree of bounce of the inner needle valve can be restrained.

As mentioned above, at the time of opening of the outer needle valve 42, because of entry of fuel having the rail pressure Pcr between the outer needle valve 42 and the outer needle valve seat portion 41*c*, the rising speed of the outer needle valve 42 immediately after the outer valve opening time depends on the differential pressure between the rail pressure Pcr and the outer control pressure Pco (outer differential pressure δPco).

As can be understood from FIG. 10, immediately after the outer valve opening time in the second conventional apparatus, the outer differential pressure δPco is greater than the differential pressure δPc. Accordingly, in this case, the rising speed of the outer needle valve 42 immediately after the outer valve opening time in the second conventional apparatus is higher than that in the first conventional apparatus.

Incidentally, immediately after the outer valve opening time, there is a tendency that the higher the rising speed of the outer needle valve 42, the higher the rate at which fuel is injected from the first nozzle holes (first nozzle hole group) 41*a* (injected fuel quantity per unit time). The higher the fuel injection rate, the greater the acceleration of the atomization of fuel injected from the first nozzle holes (first nozzle hole group) 41*a* (i.e., the diffusion of injected fuel in a combustion chamber). At low load, because of low combustion temperature, the greater the acceleration of the atomization of injected fuel, the higher the unburnt HC content of exhaust gas. That is, at low load, there is a tendency that the higher the rising speed of the outer needle valve 42 immediately after the outer valve opening time, the higher the unburnt HC content of exhaust gas.

Thus, there arises a new problem in that, at low load, the unburnt HC content of exhaust gas in the second conventional apparatus becomes higher than that in the first conventional apparatus.

Also, as in the case of opening of the outer needle valve 42, at the time of opening of the inner needle valve 43, because of entry of fuel having the rail pressure Pcr between the inner needle valve 43 and the inner needle valve seat portion 41*d*, the rising speed of the inner needle valve 43 immediately after the inner valve opening time depends on the inner differential pressure δPci.

As will be understood from FIG. 10, immediately after the inner valve opening time in the second conventional apparatus, the inner differential pressure δPci is smaller than the differential pressure δPc. Accordingly, in this case, the rising speed of the inner needle valve 43 immediately after the inner valve opening time in the second conventional apparatus is lower than that in the first conventional apparatus.

Incidentally, in a period (hereinafter, may be called "the seat choke period Tch") in which the lift of the inner needle valve 43 changes within a range not greater than a minimal lift Lmin, there arises a phenomenon in which an orifice is substantially formed between the inner needle valve 43 and the inner needle valve seat portion 41*d* (hereinafter, this phenomenon may be called "the seat choke phenomenon"). When the seat choke phenomenon occurs, because of low fuel pressure in the second nozzle holes (second nozzle hole group) 41*b*, the atomization of fuel injected from the second nozzle holes (second nozzle hole group) 41*b* is restrained. Accordingly, the longer the seat choke period Tch, the greater the restraint of the atomization of injected fuel. As a result, smoke is apt to be generated in exhaust gas.

Meanwhile, there is a tendency that the lower the rising speed of the inner needle valve 43 immediately after the inner valve opening time, the longer the seat choke period Tch. Accordingly, the seat choke period Tch in the second conventional apparatus is longer than that in the first conventional apparatus. As a result, there arises a new problem in that the smoke content of exhaust gas in the second conventional apparatus is higher than that in the first conventional apparatus.

Thus, in the second conventional apparatus, since the outer differential pressure δPco immediately after the outer valve opening time is set large, and the inner differential pressure δPci immediately after the inner valve opening time is set small, two new problems arise, namely, a high unburnt HG content in exhaust gas at low load, and a high smoke content in exhaust gas.

The two new problems can be solved by setting the outer differential pressure δPco immediately after the outer valve opening time to a small value, and also setting the inner differential pressure δPci immediately after the inner valve opening time to a large value.

Thus, an object of the present invention is to provide a fuel injection control apparatus of a twin needle type in which the outer differential pressure immediately after the outer valve opening time can be set small and in which the inner differential pressure immediately after the inner valve opening time can be set large.

A fuel injection control apparatus according to the present invention comprises a body having the above-mentioned first and second nozzle holes; the above-mentioned outer and inner needle valves; the above-mentioned nozzle chamber; the above-mentioned outer and inner control chambers; a high pressure generating section; the above-mentioned fuel supply channel; a first fuel inflow channel for connecting the fuel supply channel and the outer control chamber or the inner control chamber; the above-mentioned communication chamber; a fuel drain channel for connecting the inner control chamber and a fuel tank; and a first control valve installed in the fuel drain channel and adapted to allow and shut off communication through the fuel drain channel.

The first fuel inflow channel may be configured to connect the fuel supply channel and the outer control chamber. Preferably, a first orifice is installed in the first fuel inflow channel, and a second orifice is installed in the fuel drain channel.

According to the above-mentioned configuration, when the first control valve allows communication through the fuel drain channel, fuel in the outer control chamber flows into the inner control chamber through the communication channel, and the fuel in the inner control chamber flows out to the fuel tank through the fuel drain channel. The flow of fuel through the communication channel generates a differential pressure between the inner control pressure and the outer control pressure. By virtue of the generation of the differential pressure, the outer control pressure can change while being higher than the inner control pressure; the outer differential pressure can change while being small; and the inner differential pressure can change while being large.

Thus, the outer differential pressure immediately after the outer valve opening time can be set small. Accordingly, the speed of the outer needle valve immediately after the outer valve opening time can be rendered low. As a result, there can be restrained an increase in the unburnt HC content of exhaust gas at low load, which could otherwise result from an abrupt increase in fuel injection rate immediately after the outer valve opening time.

Also, the inner differential pressure immediately after the inner valve opening time can be set large. Accordingly, the speed of the inner needle valve immediately after the inner valve opening time can be rendered high. As a result, the seat choke period immediately after the inner valve opening time can be shortened, so that there can be restrained an increase in the smoke content of exhaust gas, which could otherwise result from the seat choke phenomenon.

Preferably, the fuel injection control apparatus according to the present invention further comprises a piece provided separately from the body, unitarily fixed to the body, and adapted to separate the nozzle chamber and the outer control chamber from each other, and the piece has a stopper for limiting a lift of the outer needle valve.

According to the above-mentioned configuration, in a state in which the lift of the inner needle valve is "0," the collision of the outer needle valve against the inner needle valve can be prevented. Accordingly, bounce of the inner needle valve can be prevented. Also, since the stopper is provided on the piece, which is a member provided separately from the body, as compared with the case where the stopper is provided on the body, there can be readily fabricated a fuel injection control apparatus in which bounce of the inner needle valve can be prevented.

Preferably, the fuel injection control apparatus according to the present invention further comprises a second fuel inflow channel for connecting the fuel supply channel and the inner control chamber, and a second control valve installed in the second fuel inflow channel and adapted to shut off the second fuel inflow channel when the first control valve allows communication through the fuel drain channel, and to allow communication through the second fuel inflow channel when the first control valve shuts off the fuel drain channel. In this case, preferably, in view of reduction in size of the fuel injection control apparatus, the first control valve and the second control valve are configured to be integral with each other.

Generally, even immediately before the inner valve closing time, similar to the case immediately after the inner valve opening time, the seat choke phenomenon occurs. For shortening the seat choke period immediately before the inner valve closing time, the lowering speed of the inner needle valve immediately before the inner valve closing time may be rendered high.

The above-mentioned configuration is based on the findings mentioned above. According to the configuration, as compared with the case where only the first fuel supply channel is provided, the total flow rate of fuel which flows into the inner control chamber when the fuel drain channel is shut off can be rendered high. Accordingly, as compared with the case where only the first fuel supply channel is provided, the lowering speed of the inner needle valve immediately before the inner valve closing time can be rendered high. As a result, the seat choke period immediately before the inner valve closing time can be shortened.

BEST MODE FOR CARRYING OUT THE INVENTION

Embodiments of a fuel injection control apparatus according to the present invention will next be described with reference to the drawings.

First Embodiment

Figure 1:
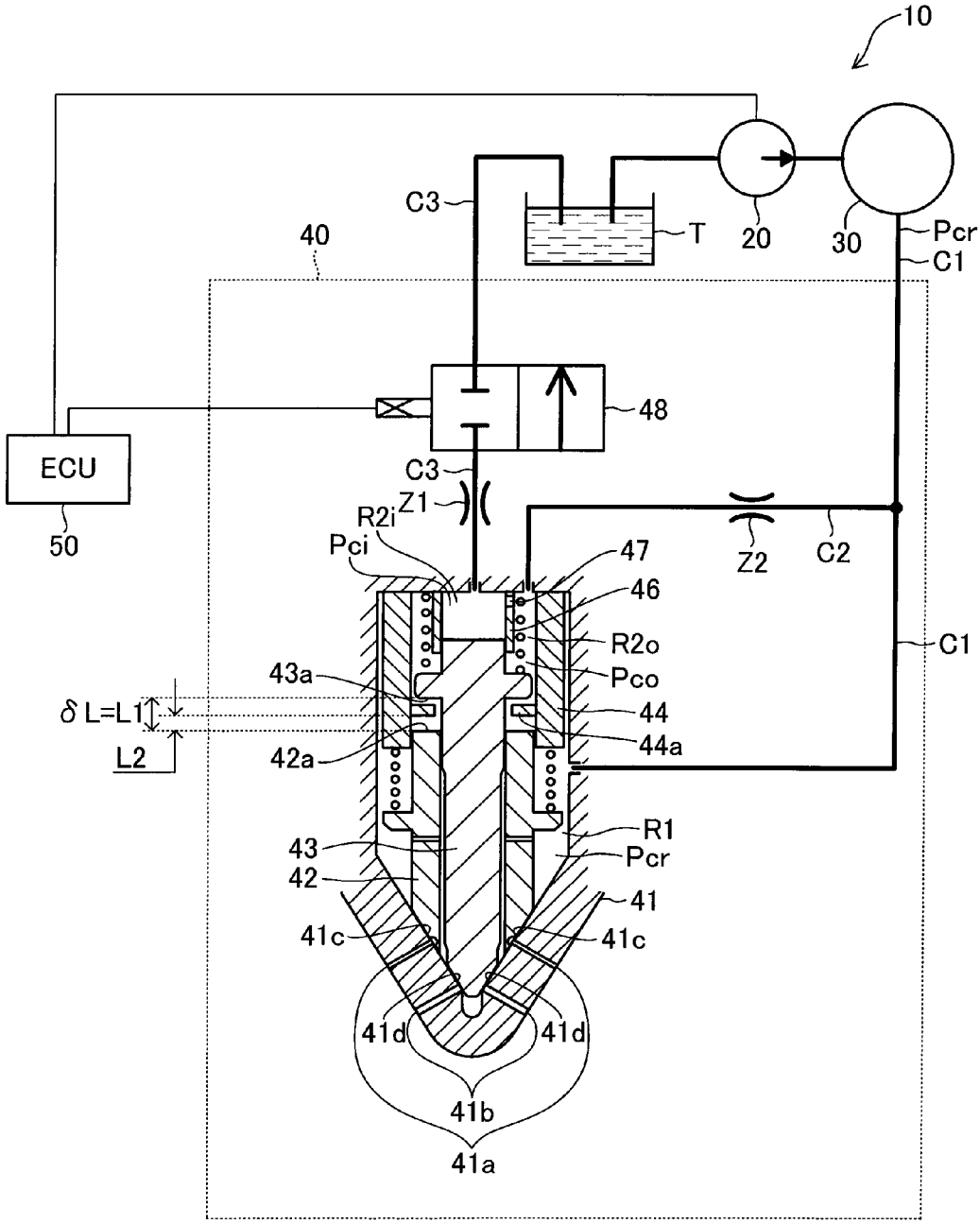
FIG. 1 is a schematic view showing the overall configuration of a fuel injection control apparatus according to a first embodiment of the present invention.
Figure 9:
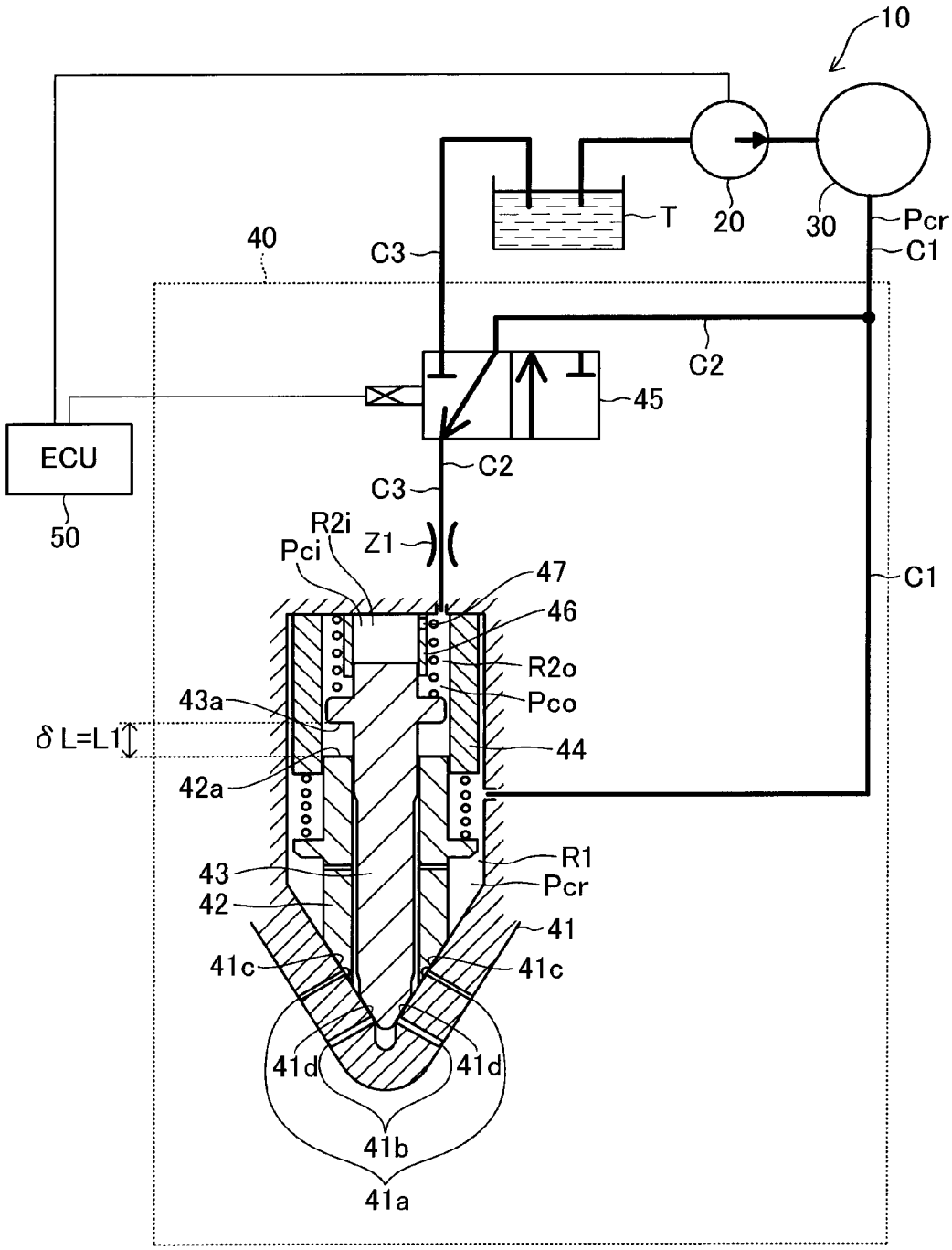
FIG. 9 is a schematic view showing the overall configuration of a second conventional apparatus.

FIG. 1 shows a schematic overall configuration of a fuel injection control apparatus 10 of an internal combustion engine (diesel engine) according to a first embodiment of the present invention. In FIG. 1, members and portions similar to or equivalent to those shown in FIG. 9 are denoted by reference numerals similar to those shown in FIG. 9, and redundant description thereof is omitted.

The first embodiment differs from the aforementioned second conventional apparatus only in the following three points. First, in place of the 2-position 3-port control valve 45 of the second conventional apparatus, a 2-position 2-port on-off control valve 48 for opening and closing the fuel drain channel C3 is installed. The on-off control valve 48 corresponds to the aforementioned first control valve.

Secondly, the fuel inflow channel C2 is provided independent of the on-off control valve 48, and an end of the fuel inflow channel C2 which is located on a side toward the control chamber is connected to the outer control chamber R2*o*. The fuel inflow channel C2 has an orifice Z2 installed therein and having the same cross-sectional area of opening as that of the orifice Z1. Irrespective of whether the on-off control valve 48 is opened or closed, the fuel inflow channel C2 establishes communication between the fuel supply channel C1 and the outer control chamber R2*o* at all times. Additionally, an end of the fuel drain channel C3 which is located on the side toward the control chamber is connected to the inner control chamber R2*i*. The fuel inflow channel C2 corresponds to the aforementioned first fuel inflow channel, and the orifice Z1 and the orifice Z2 correspond to the aforementioned second orifice and the aforementioned first orifice, respectively.

Thirdly, the piece 44 has a ringlike stopper 44*a*, which projects radially inward from its inner circumferential surface. The stopper 44*a* limits the lift of the outer needle valve 42 such that the maximum lift becomes a value L2 (<the value L1 mentioned above). Thus, bounce of the inner needle valve can be prevented.

Figure 2:
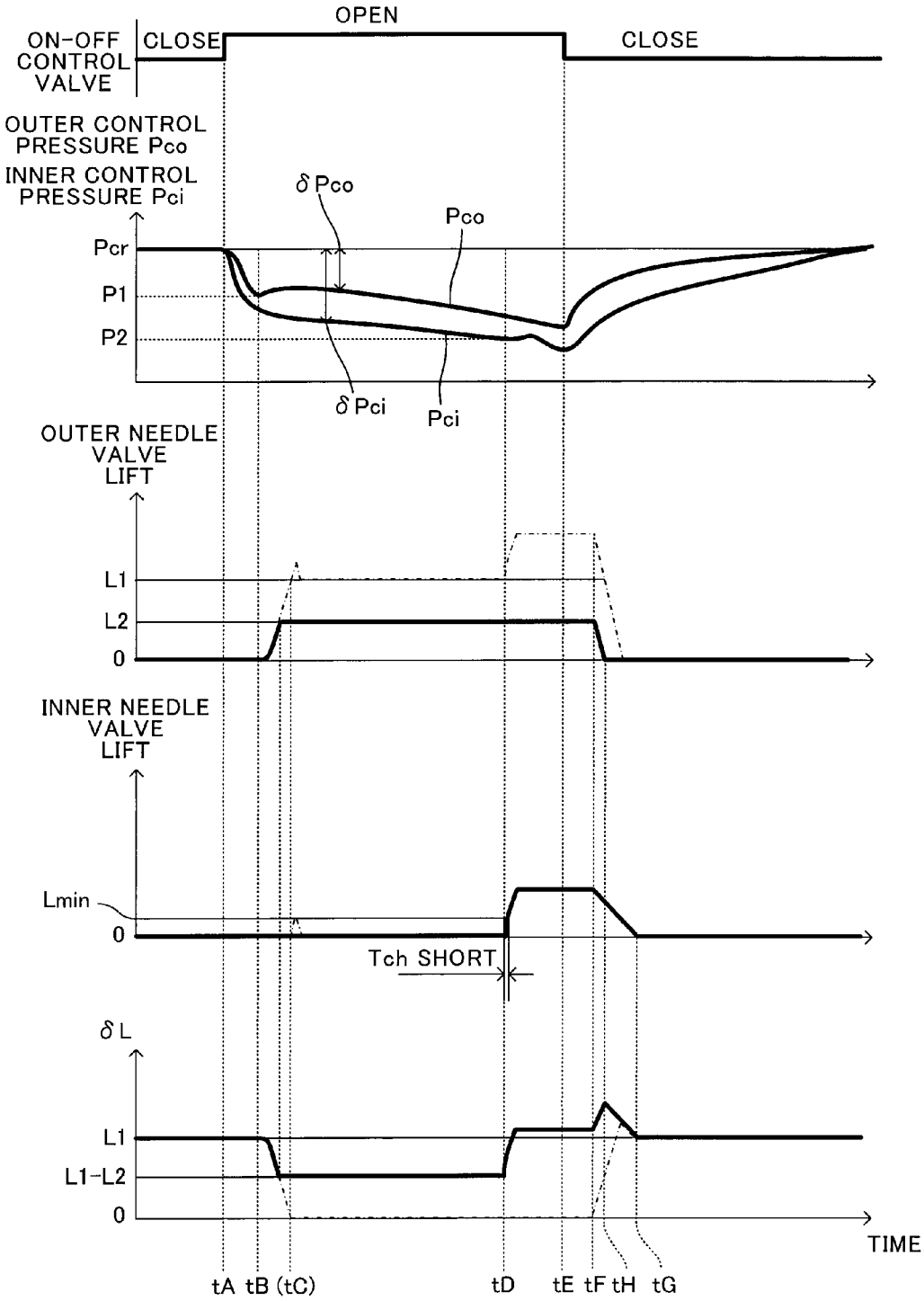
FIG. 2 is a time chart showing an example operation of the first embodiment of the present invention.
Figure 10:
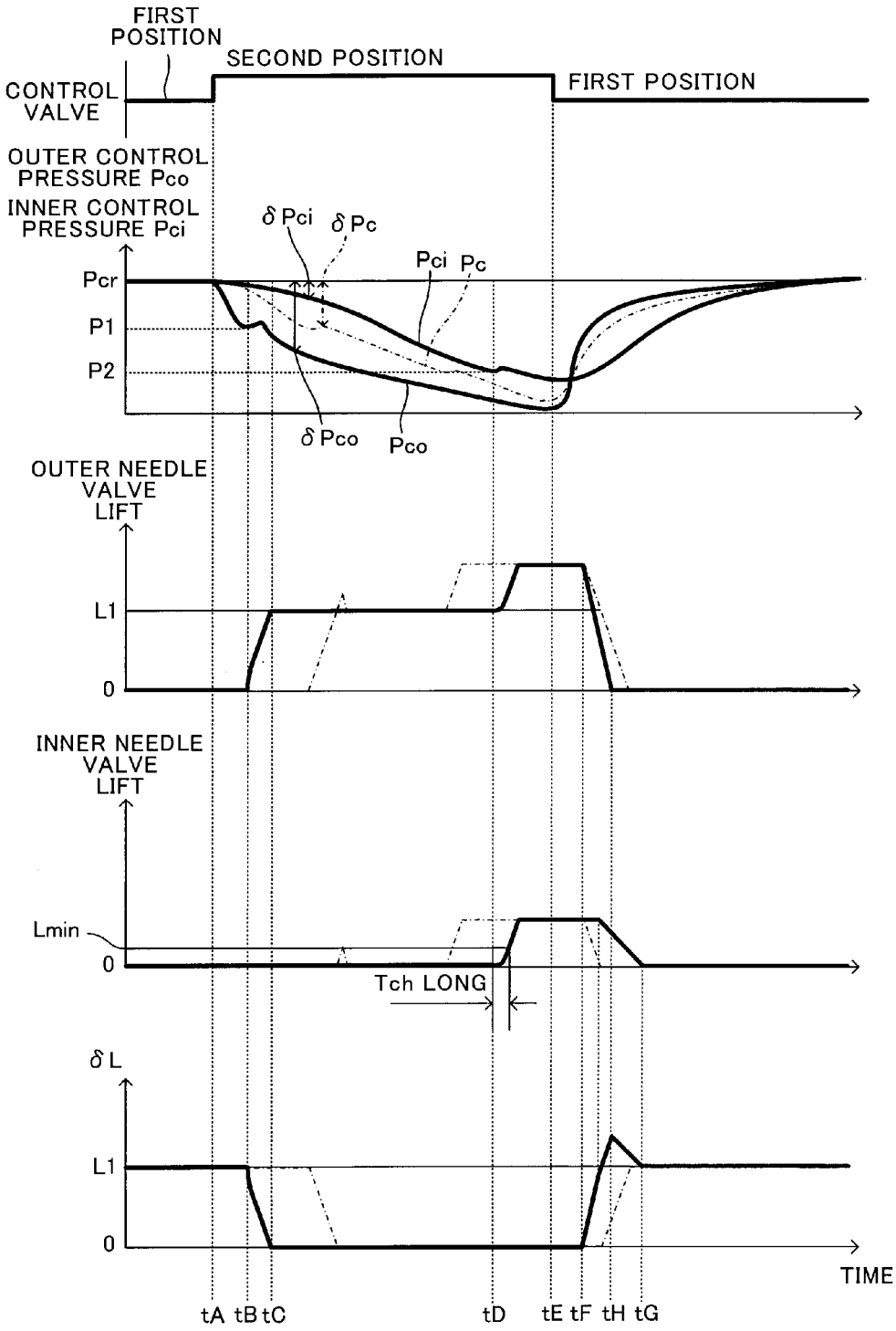
FIG. 10 is a time chart showing an example operation of the second conventional apparatus.

Next, referring to FIG. 2, an example operation of the first embodiment will be described. Times tA to tH in FIG. 2 correspond to those in FIG. 10. As shown in FIG. 2, according to the first embodiment, at and after time tA, fuel in the fuel supply channel C1 flows into the outer control chamber R2*o* through the fuel inflow channel C2; fuel in the outer control chamber R2*o* flows into the inner control chamber R2*i* through the communication channel 47; and fuel in the inner control chamber R2*i* flows out to the fuel tank T through the fuel drain channel C3. At and after time tA, the flow of fuel through the communication channel 47 causes the generation of differential pressure between the outer control pressure Pco and the inner control pressure Pci. Because of the occurrence of the differential pressure, the outer control pressure Pco changes while being higher than the inner control pressure Pci; the outer differential pressure δPco changes while being small; and the inner differential pressure δPci changes while being large.

Thus, according to the first embodiment of the fuel injection control apparatus according to the present invention, the outer differential pressure δPco immediately after the outer valve opening time can be set small, and the inner differential pressure δPci immediately after the inner valve opening time can be set large. As a result, there can be restrained an increase in the unburnt HC content of exhaust gas at low load, which could otherwise result from an abrupt increase in fuel injection rate immediately after the outer valve opening time. Also, there can be restrained an increase in the smoke content of exhaust gas, which could otherwise result from the seat choke phenomenon.

Notably, even though the inner differential pressure δPci immediately after the inner valve opening time is set large, since load when the inner needle valve 43 opens is relatively large (i.e., combustion temperature is relatively high), an increase in the unburnt HC content of exhaust gas caused by an abrupt increase in fuel injection rate immediately after the inner valve opening time is unlikely to occur.

Additionally, as shown in FIG. 2, since the lift of the outer needle valve 42 is limited to the value L2 or less, bounce of the inner needle valve (see the dash-dot line in FIG. 2) can be prevented.

Figure 3:
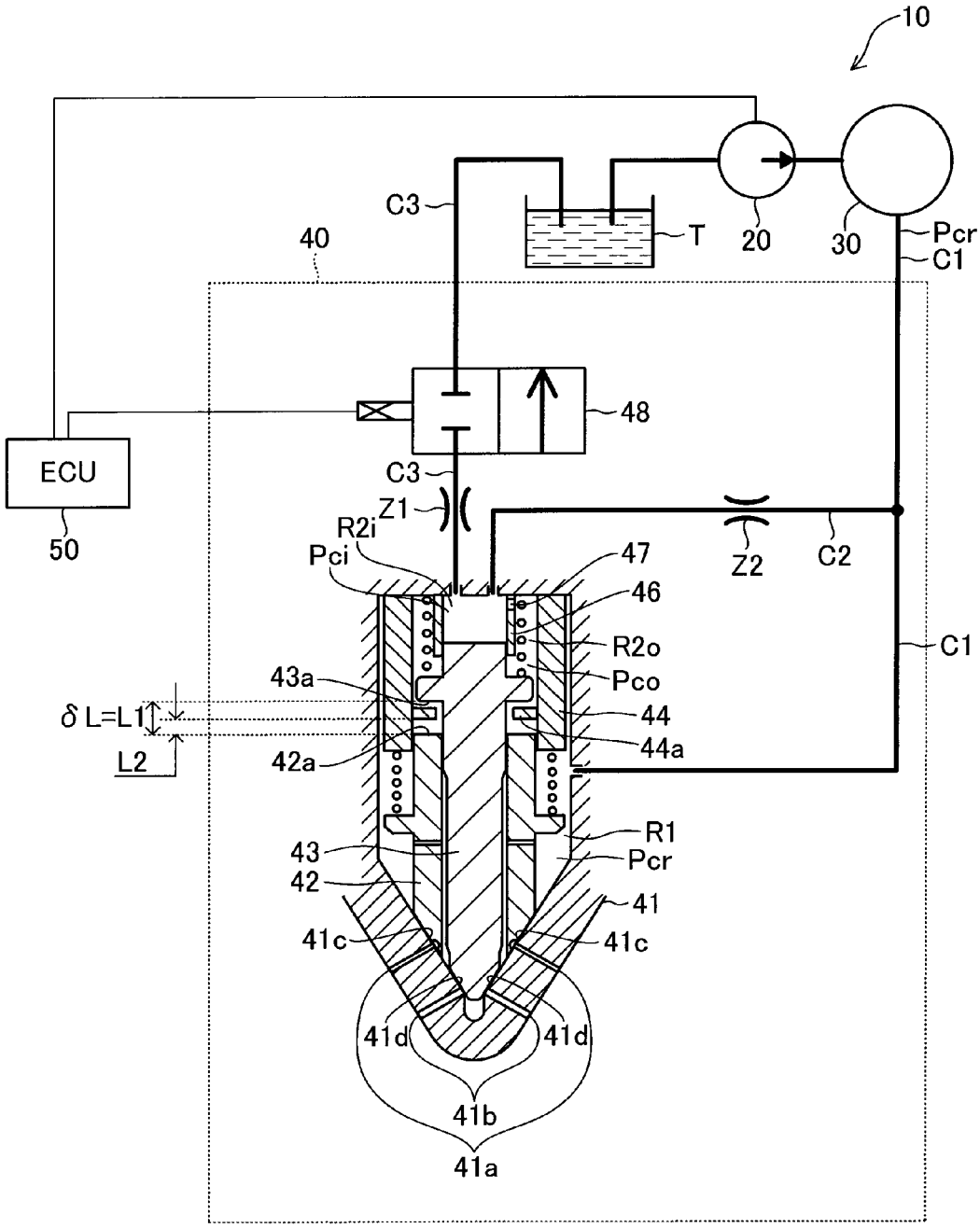
FIG. 3 is a schematic view showing the overall configuration of a fuel injection control apparatus according to a first modification of the first embodiment of the present invention.

The present invention is not limited to the above-described embodiment. Numerous modifications and variations of the present invention are possible without departing from the scope of the invention. Modifications of the first embodiment will next be described. FIG. 3 shows a schematic overall configuration of an apparatus according to a first modification of the first embodiment. In FIG. 3, members and portions similar to or equivalent to those shown in FIG. 1 are denoted by reference numerals similar to those shown in FIG. 1, and redundant description thereof is omitted. The first modification differs from the first embodiment only in that an end of the fuel inflow channel C2 which is located on the side toward the control chamber is connected to the inner control chamber R2*i*, so that communication is established at all times between the fuel supply channel C1 and the inner control chamber R2*i* through the fuel inflow channel C2.

Thus, irrespective of whether the on-off control valve 48 is opened or closed, fuel can flow into the inner control chamber R2*i* at all times. Accordingly, in a state in which the on-off control valve 48 is closed, as compared with the first embodiment, the rising rate of the inner control pressure Pci can be high. As a result, as compared with the first embodiment, the seat choke period Tch immediately before the inner valve closing time can be shortened.

Figure 4:
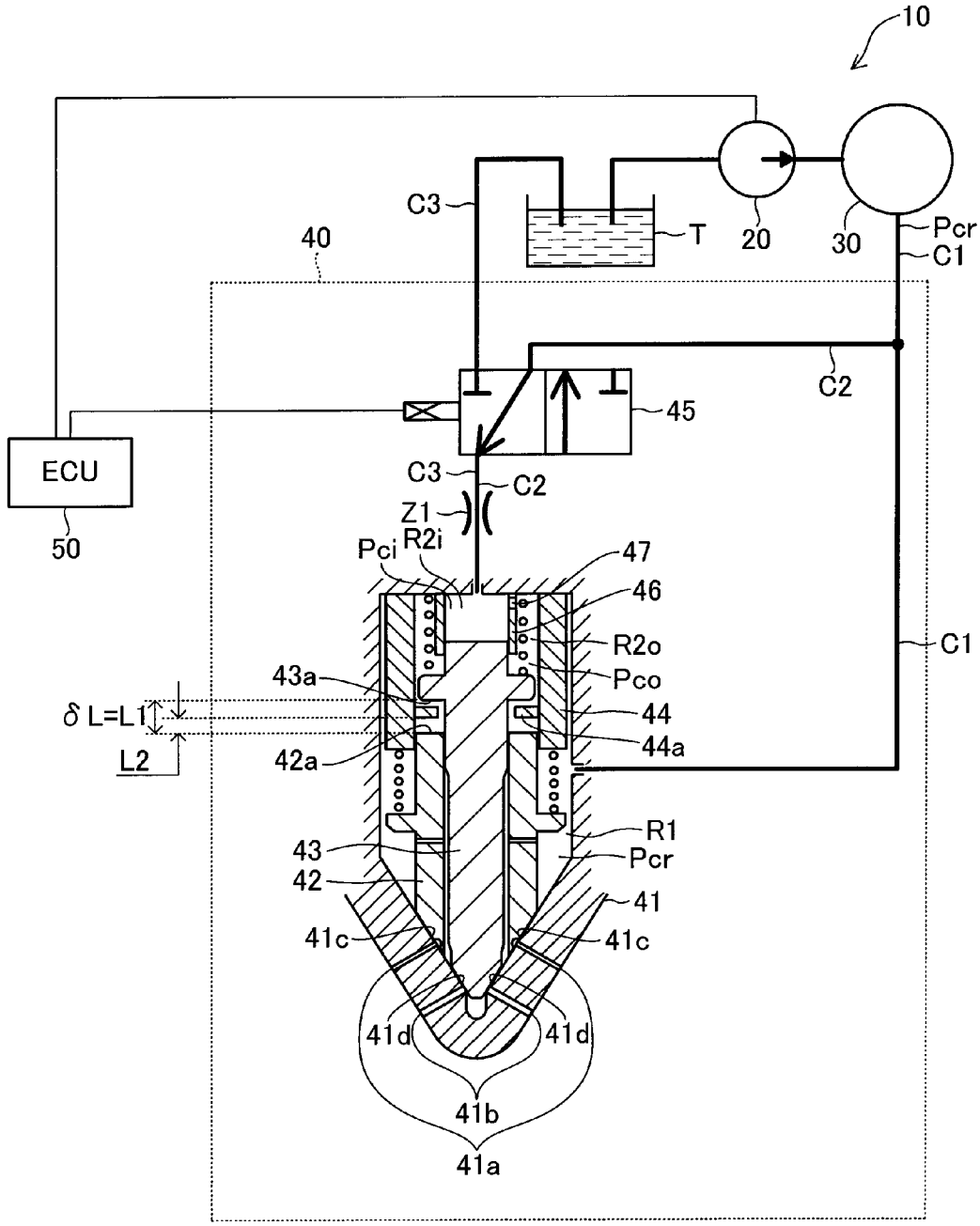
FIG. 4 is a schematic view showing the overall configuration of a fuel injection control apparatus according to a second modification of the first embodiment of the present invention.

FIG. 4 shows a schematic overall configuration of an apparatus of a second modification of the first embodiment. In FIG. 4, members and portions similar to or equivalent to those shown in FIG. 3 are denoted by reference numerals similar to those shown in FIG. 3, and redundant description thereof is omitted. The second modification differs from the above-described first modification only in that, in place of the on-off control valve 48 of the first modification, the 2-position 3-port control valve 45 is installed and that, through establishment of communication through the fuel inflow channel C2, the flow of fuel to the inner control chamber R2*i* through the fuel inflow channel C2 is ensured. Thus, similar to the first modification, as compared with the first embodiment, the seat choke period Tch immediately before the inner valve closing time can be shortened.

Second Embodiment

Figure 5:
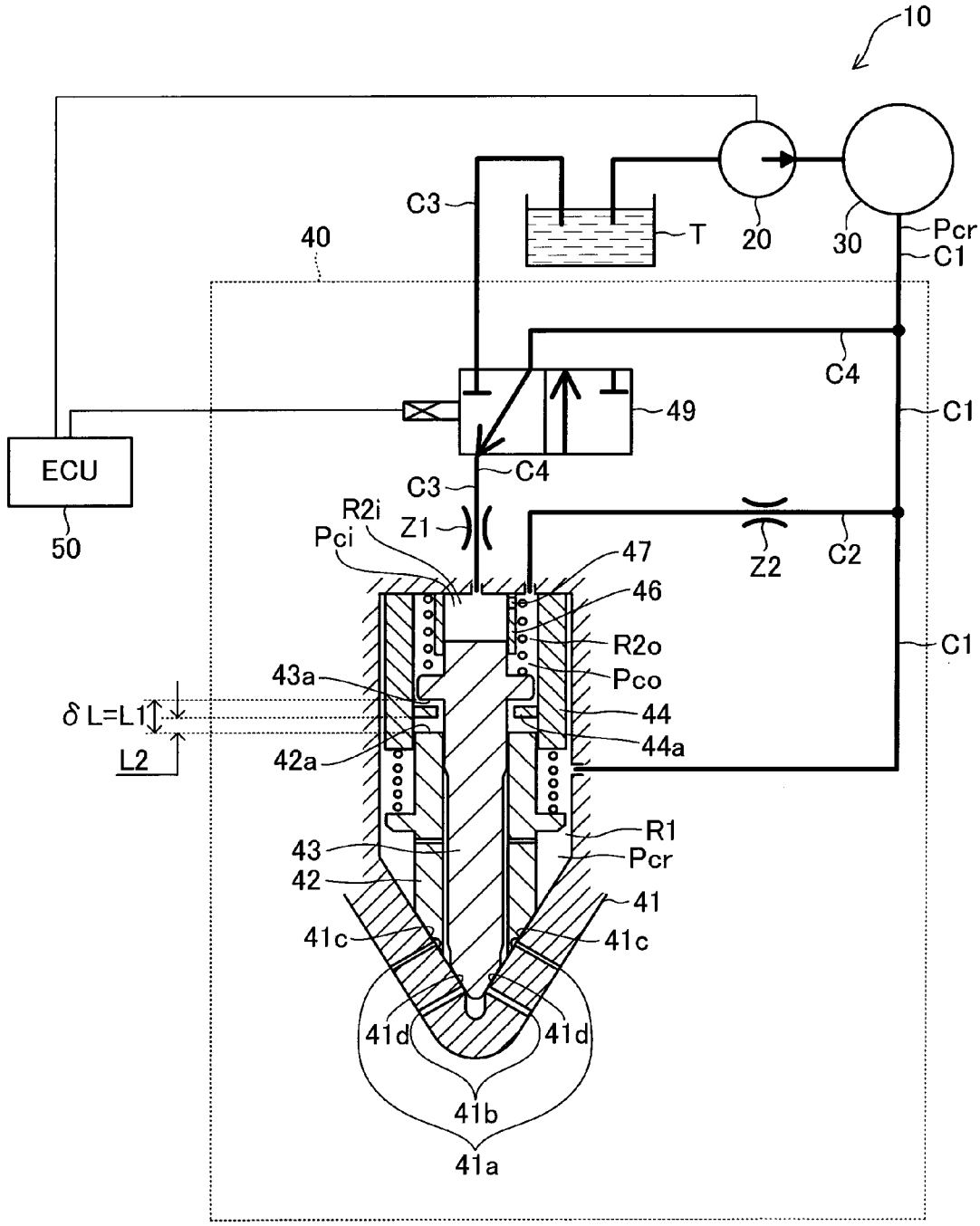
FIG. 5 is a schematic view showing the overall configuration of a fuel injection control apparatus according to a second embodiment of the present invention.

Next, the fuel injection control apparatus 10 of an internal combustion engine according to a second embodiment of the present invention will be described. FIG. 5 shows a schematic overall configuration of the apparatus of the second embodiment. In FIG. 5, members and portions similar to or equivalent to those shown in FIG. 1 are denoted by reference numerals similar to those shown in FIG. 1, and redundant description thereof is omitted.

The second embodiment differs from the first embodiment only in that, in place of the on-off control valve 48 of the first embodiment, a 2-position 3-port control valve 49 is employed and that a second fuel inflow channel C4 for connecting the fuel supply channel C1 and the inner control chamber R2*i* through the control valve 49 is provided. When the control valve 49 shuts off the fuel drain channel C3, communication through the second fuel inflow channel C4 is established (first position as shown in FIG. 5). When the control valve 49 establishes communication through the fuel drain channel C3, the second fuel inflow channel C4 is shut off (second position). That is, according to the second embodiment, in addition to a fuel flow channel from the fuel supply channel C1 to the outer control chamber R2*o* via the fuel inflow channel C2, a fuel flow channel from the fuel supply channel C1 to the inner control chamber R2*i* via the second fuel inflow channel C4 is provided. The control valve 49 corresponds to a one-piece structure in which the aforementioned first control valve and the aforementioned second control valve are integral with each other.

Figure 6:
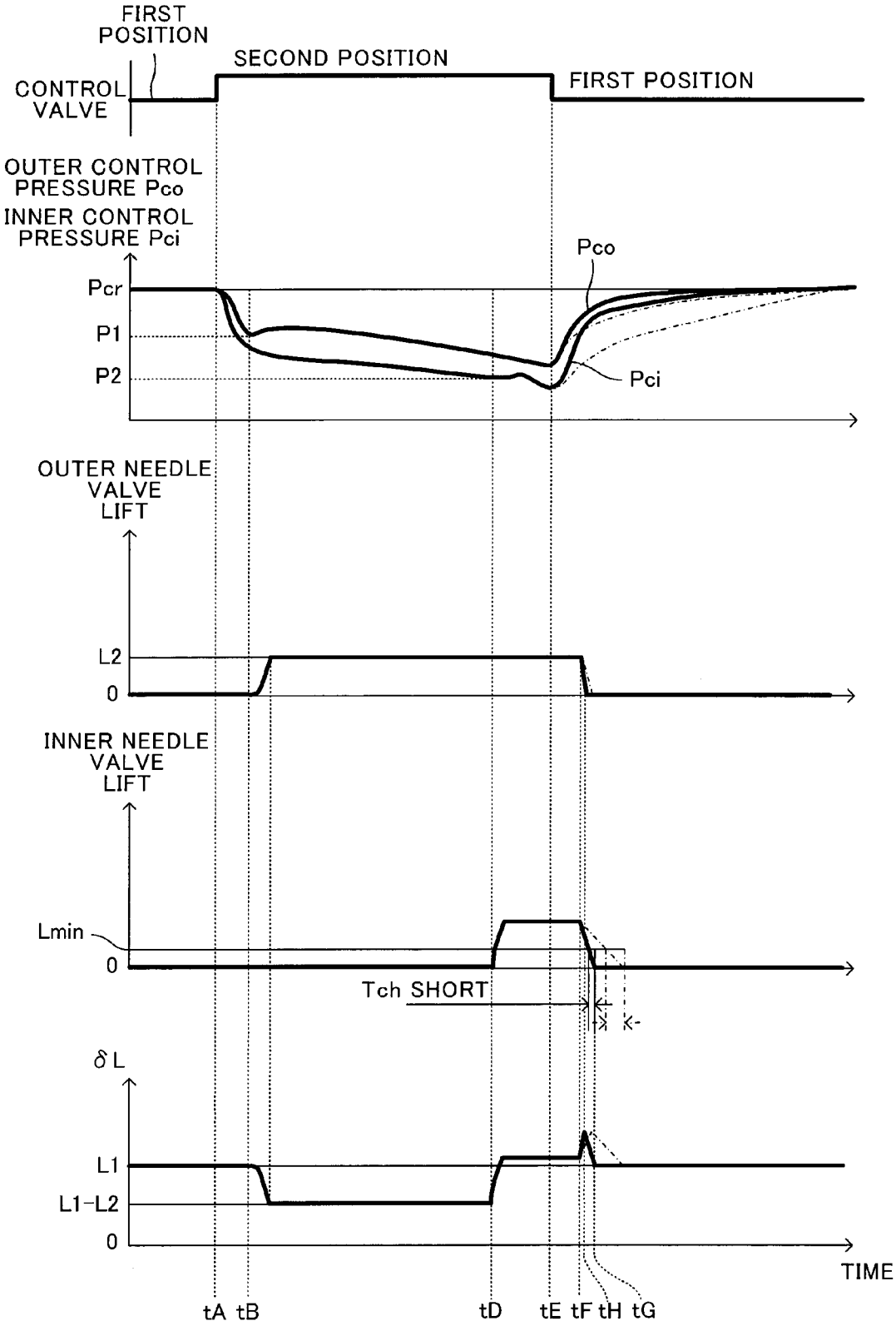
FIG. 6 is a time chart showing an example operation of the second embodiment of the present invention.
Figure 7:
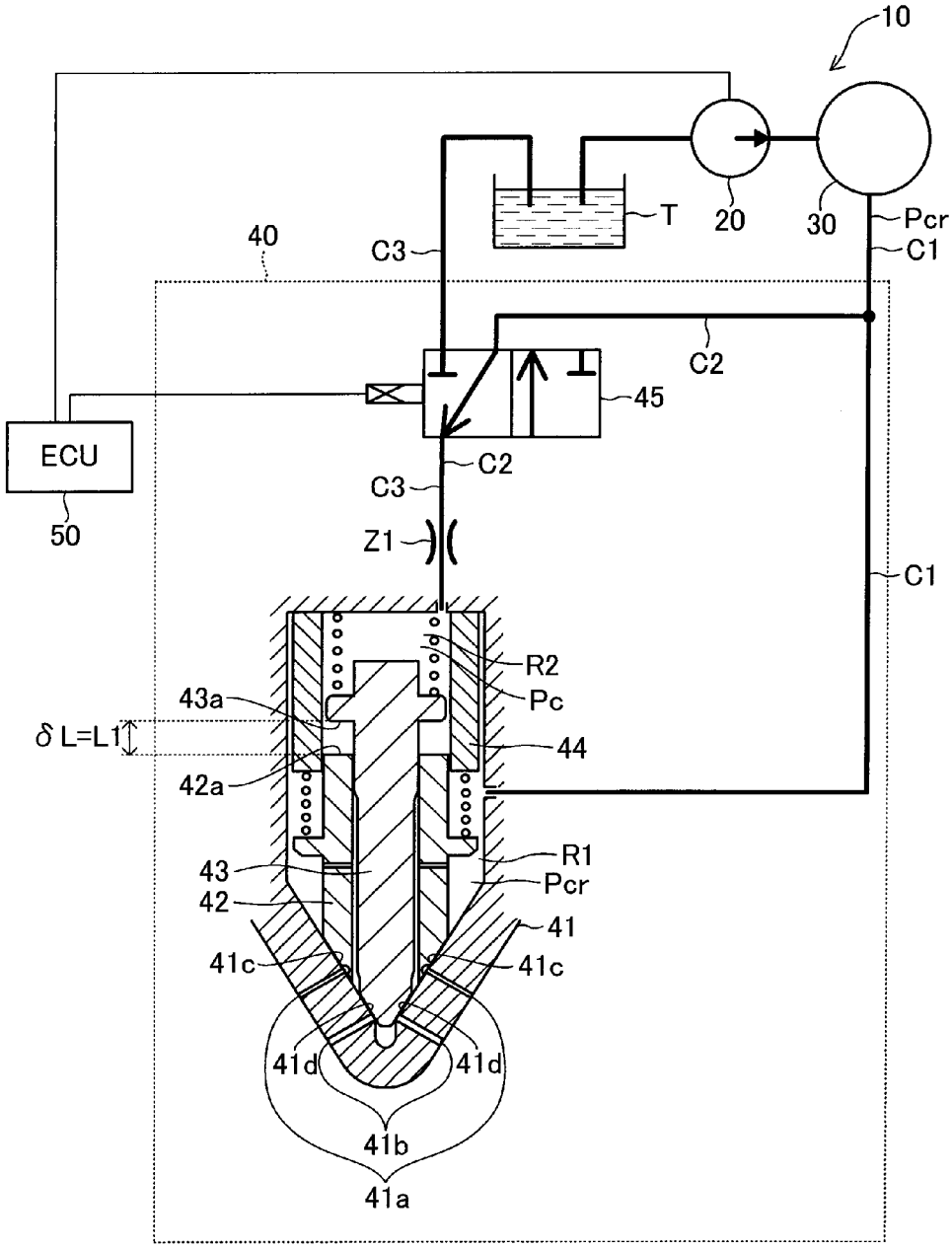
FIG. 7 is a schematic view showing the overall configuration of a first conventional apparatus.
Figure 8:
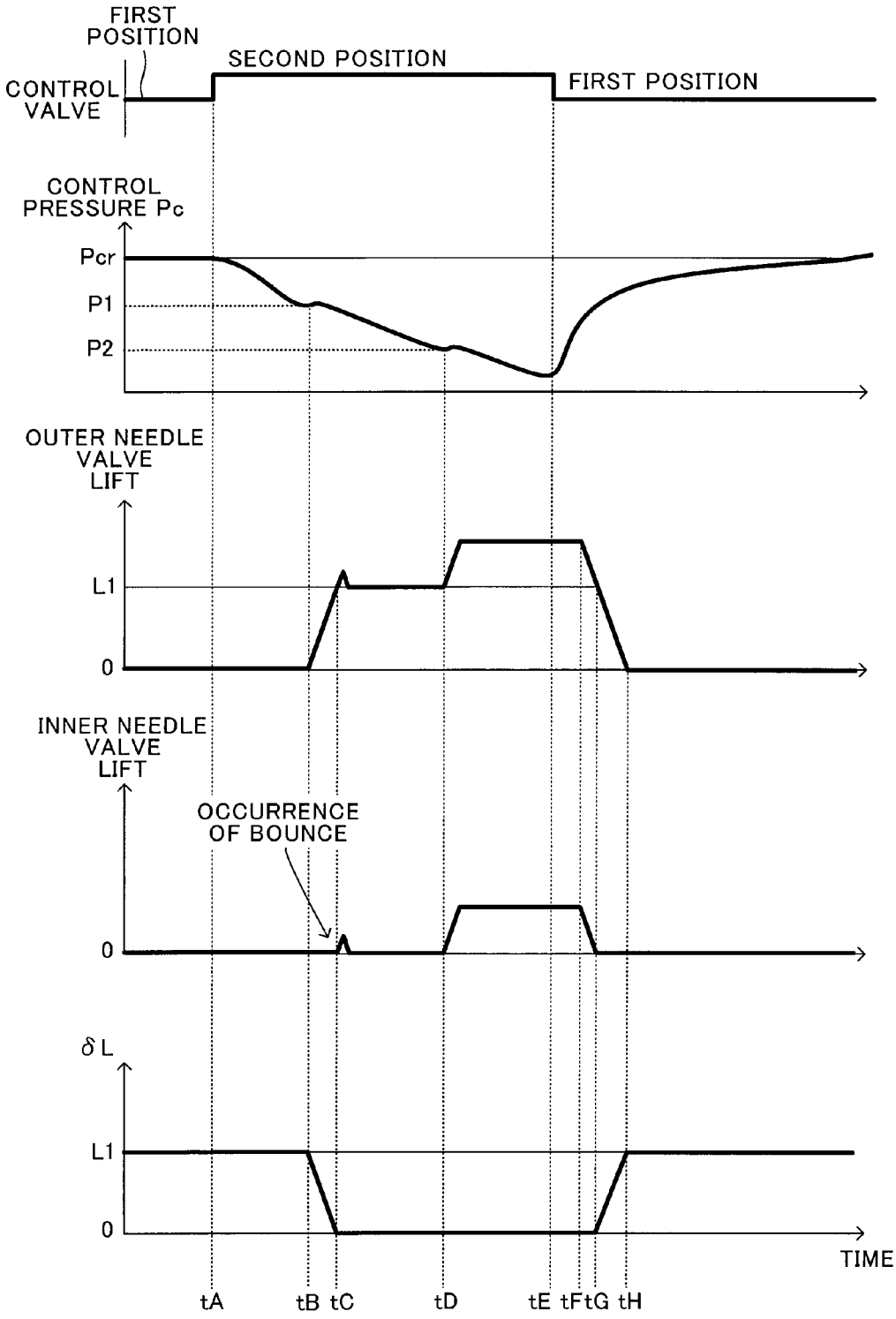
FIG. 8 is a time chart showing an example operation of the first conventional apparatus.

Next, referring to FIG. 6, an example operation of the second embodiment will be described. Times tA to tH in FIG. 6 correspond to those in FIG. 2. As shown in FIG. 6, according to the second embodiment, at and after time tE, in addition to the flow of fuel into the inner control chamber R2*i* from the outer control chamber R2*o* through the communication channel 47, fuel also flows into the inner control chamber R2*i* from the fuel supply channel C1 through the second fuel inflow channel C4. Accordingly, the rising rate of the inner control pressure Pci at and after time tE is higher than that in the first embodiment (see the dash-dot line in FIG. 6).

Thus, according to the second embodiment of the fuel injection control apparatus according to the present invention, as compared with the first embodiment, the seat choke period Tch immediately before the inner valve closing time can be shortened.

Also, as shown in FIG. 6, as compared with the first embodiment, since the rising rate of the inner control pressure Pci at and after time tE is high, the flow rate of fuel flowing out from the outer control chamber R2*o* to the inner control chamber R2*i* through the communication channel 47 is low. For this reason, the rising rate of the outer control pressure Pco at and after time tE is also higher than that in the first embodiment (see the dash-dot line in FIG. 6).

As a result, even when the lowering speeds of the outer and inner needle valves 42 and 43 vary, as compared with the first embodiment, the respective degrees of variations of the outer valve closing time and the inner valve closing time can be rendered small. That is, as compared with the first embodiment, the degree of variations of total injected fuel quantity can be rendered small.

The present invention is not limited to the above-described embodiment. Numerous modifications and variations of the present invention are possible without departing from the scope of the invention. For example, the second embodiment employs only a single 2-position 3-port control valve 49. However, the control valve 49 may be replaced with two on-off control valves as follows: a first on-off control valve and a second on-off control valve are installed in the fuel drain channel C3 and the second fuel inflow channel C4, respectively, and operate in such an interlocking relation that, when the first (second) on-off control valve is opened (closed), the second (first) on-off control valve is closed (opened). In this case, the first and second on-off control valves correspond to the aforementioned first and second control valves, respectively.

Additionally, in the above-described embodiments, the stopper 44*a* is disposed on the piece 44. However, the stopper 44*a* may be disposed on the body 41 itself.

The invention claimed is:

1. A fuel injection control apparatus comprising:

a body having a first nozzle hole formed in its tip portion facing a combustion chamber of an internal combustion engine, and a second nozzle hole formed in the tip portion and located between the first nozzle hole and the tip of the body;

an outer needle valve having a tubular form, slidably accommodated in the body, and adapted to open and close the first nozzle hole with its tip portion;

an inner needle valve having a rodlike form, slidably accommodated in the outer needle valve, and adapted to open and close the second nozzle hole with its tip portion;

a nozzle chamber which is provided on the tip side of the outer and inner needle valves and in which rail pressure, which is pressure of fuel within the nozzle chamber, applies force to the outer and inner needle valves from the tip side in a valve opening direction, the fuel within the nozzle chamber being injected into the combustion chamber through the first and second nozzle holes in a state in which the outer and inner needle valves are opened;

an outer control chamber which is provided on the back side of the outer needle valve and in which outer control pressure, which is pressure of fuel within the outer control chamber, applies force to the outer needle valve from the back side in a valve closing direction;

an inner control chamber which is provided on the back side of the inner needle valve and in which inner control pressure, which is pressure of fuel within the inner control chamber, applies force to the inner needle valve from the back side in the valve closing direction;

a high pressure generating section for generating fuel having the rail pressure;

a fuel supply channel for connecting the high pressure generating section and the nozzle chamber;

a first fuel inflow channel for connecting the fuel supply channel and the outer control chamber or the inner control chamber;

a communication channel for establishing communication between the outer control chamber and the inner control chamber;

a fuel drain channel for connecting the inner control chamber and a fuel tank;

a first control valve installed in the fuel drain channel and adapted to allow and shut off communication through the fuel drain channel; and a piece provided separately from the body, unitarily fixed to the body, and adapted to separate the nozzle chamber and the outer control chamber from each other, the piece having a stopper for limiting a lift of the outer needle valve, wherein the piece is disposed between the nozzle chamber and the outer control chamber.

2. A fuel injection control apparatus according to claim 1, wherein the first fuel inflow channel is configured to connect the fuel supply channel and the outer control chamber.

3. A fuel injection control apparatus according to claim 1, wherein a first orifice is installed in the first fuel inflow channel, and a second orifice is installed in the fuel drain channel.

4. A fuel injection control apparatus according to claim 1, further including a cylindrical member unitarily fixed to the body and fitted around an upper end portion of the inner needle valve, wherein the communication channel is formed in the cylindrical member.

5. A fuel injection control apparatus according to claim 1, wherein:

the inner needle valve includes a flange at an upper end portion of the inner needle valve; and the piece prevents an upper end surface of the outer needle valve from contacting a lower surface of the flange.

6. A fuel injection control apparatus comprising:

a body having a first nozzle hole formed in its tip portion facing a combustion chamber of an internal combustion engine, and a second nozzle hole formed in the tip portion and located between the first nozzle hole and the tip of the body;

an outer needle valve having a tubular form, slidably accommodated in the body, and adapted to open and close the first nozzle hole with its tip portion;

an inner needle valve having a rod like form, slidably accommodated in the outer needle valve, and adapted to open and close the second nozzle hole with its tip portion;

a nozzle chamber which is provided on the tip side of the outer and inner needle valves and in which rail pressure, which is pressure of fuel within the nozzle chamber, applies force to the outer and inner needle valves from the tip side in a valve opening direction, the fuel within the nozzle chamber being injected into the combustion chamber through the first and second nozzle holes in a state in which the outer and inner needle valves are opened;

an outer control chamber which is provided on the back side of the outer needle valve and in which outer control pressure, which is pressure of fuel within the outer control chamber, applies force to the outer needle valve from the back side in a valve closing direction;

an inner control chamber which is provided on the back side of the inner needle valve and in which inner control pressure, which is pressure of fuel within the inner control chamber, applies force to the inner needle valve from the back side in the valve closing direction;

a high pressure generating section for generating fuel having the rail pressure;

a fuel supply channel for connecting the high pressure generating section and the nozzle chamber;

a first fuel inflow channel for connecting the fuel supply channel and the outer control chamber or the inner control chamber;

a communication channel for establishing communication between the outer control chamber and the inner control chamber;

a fuel drain channel for connecting the inner control chamber and a fuel tank;

a first control valve installed in the fuel drain channel and adapted to allow and shut off communication through the fuel drain channel;

a second fuel inflow channel for connecting the fuel supply channel and the inner control chamber; and a second control valve installed in the second fuel inflow channel and adapted to shut off the second fuel inflow channel when the first control valve allows communication through the fuel drain channel, and to allow communication through the second fuel inflow channel when the first control valve shuts off the fuel drain channel.

7. A fuel injection control apparatus according to claim 6, wherein the first control valve and the second control valve are configured to be integral with each other.

8. A fuel injection control apparatus according to claim 6, wherein the first fuel inflow channel is configured to connect the fuel supply channel and the outer control chamber.

9. A fuel injection control apparatus according to claim 6, wherein a first orifice is installed in the first fuel inflow channel, and a second orifice is installed in the fuel drain channel.

10. A fuel injection control apparatus according to claim 6, further including a piece provided separately from the body, unitarily fixed to the body, and adapted to separate the nozzle chamber and the outer control chamber from each other, the piece having a stopper for limiting a lift of the outer needle valve, wherein the piece is disposed between the nozzle chamber and the outer control chamber.

11. A fuel injection control apparatus according to claim 6, further including a cylindrical member unitarily fixed to the body and fitted around an upper end portion of the inner needle valve, wherein the communication channel is formed in the cylindrical member.

* * * * *